US008070454B1

(12) United States Patent
Rawlings

(10) Patent No.: US 8,070,454 B1
(45) Date of Patent: Dec. 6, 2011

(54) TURBINE AIRFOIL WITH TRAILING EDGE

(75) Inventor: Christopher K. Rawlings, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1027 days.

(21) Appl. No.: 12/001,514

(22) Filed: Dec. 12, 2007

(51) Int. Cl.
*F01D 5/18* (2006.01)

(52) U.S. Cl. ..... 416/241 R; 416/228

(58) Field of Classification Search ..... 416/241 R, 416/241 A, 228
See application file for complete search history.

(56) References Cited

U.S. PATENT DOCUMENTS

| | | | | |
|---|---|---|---|---|
| 4,504,189 | A | 3/1985 | Lings | |
| 5,174,715 | A | 12/1992 | Martin | |
| 5,209,645 | A * | 5/1993 | Kojima et al. | 416/241 B |
| 5,299,909 | A | 4/1994 | Wulf | |
| 6,109,869 | A | 8/2000 | Maddaus et al. | |
| 6,241,469 | B1 * | 6/2001 | Beeck et al. | 415/115 |
| 6,616,406 | B2 * | 9/2003 | Liang | 416/97 R |
| 6,681,558 | B2 | 1/2004 | Orlando et al. | |
| 6,789,315 | B2 | 9/2004 | Marques et al. | |
| 7,491,033 | B2 * | 2/2009 | Trishkin et al. | 416/241 R |
| 2008/0232971 | A1 * | 9/2008 | Ahmad et al. | 416/233 |

* cited by examiner

*Primary Examiner* — Ninh H Nguyen
(74) *Attorney, Agent, or Firm* — John Ryznic

(57) ABSTRACT

A turbine airfoil with a relatively thick TBC applied over the airfoil surface. The airfoil has a surface contour on the trailing edge region with a forward end having a large amount of taper and a rearward end with less taper such that a substantially constant wall thickness is formed in the rearward end. The TBC is applied over the airfoil surface and tapers off at the trailing edge ends on the pressure side and the suction side walls to produce an ideal surface contour on the airfoil. In another embodiment, the airfoil surface includes a tapered section at the trailing edge region, and the TBC is applied over the taper so that an over-coating is formed. The TBC over-coating is then removed and a smooth and ideal surface contour is produced along the airfoil surface. Small raised bumps each having a height of the desired thickness of the TBC to be applied over the respective bump is used to control the finished thickness of the TBC.

20 Claims, 4 Drawing Sheets

TURBINE AIRFOIL WITH TRAILING EDGE

BACKGROUND OF THE INVENTION

1. Field of the Invention

The present invention relates generally to a gas turbine engine, and more specifically to a throat formed between adjacent stator vanes.

2. Description of the Related Art including information disclosed under 37 CFR 1.97 and 1.98

In a gas turbine engine, the turbine converts the energy of the passing hot gas flow into mechanical energy to drive the rotor shaft. In an aero engine, the turbine provides a majority of the mechanical power to the fan. In an industrial gas turbine (IGT) engine, the majority of power delivered to the rotor shaft is used to drive an electric generator for electrical power production. In either case, the efficiency of the engine is directly related to the efficiency of the turbine.

One method of improving the efficiency of the turbine is to place a row of stator or guide vanes directly upstream from a stage of rotor blades in order to direct the hot gas flow into the rotor blades at the most opportune angle to produce the greatest reaction. The nozzle guide vanes have two principal functions. First, they must convert part of the gas heat and pressure energy into dynamic or kinetic energy, so that the gas will strike the turbine blades with some degree of force. Second, the nozzle vanes must turn this gas flow so that it will impinge on the turbine blades in the proper direction; that is, the gasses must impact on the turbine blade plane of the rotor. The nozzle does its first job by using the Bernoulli theorem. As through any nozzle, when the flow area is restricted, the gas will accelerate and a large portion of the static pressure in the gas is turned into dynamic pressure. The degree to which this effect will occur depends upon the relationship between the nozzle guide vane inlet and exit areas, which, in turn, is closely related to the type of turbine blade used.

Adjacent nozzles form a throat between the suction side wall of one vane and the pressure side wall of the adjacent vane. Making the nozzle area too small will restrict the airfoil through the engine, raise compressor discharge pressure, and bring the compressor closer to stall. Nozzle area is especially critical during acceleration, when the nozzle will have a tendency to choke (gas flowing at the speed of sound). Small exit areas also cause slower accelerations because the compressor will have to work against an increased back pressure. Increasing the nozzle diaphragm area will result in faster engine acceleration, less tendency to stall, but higher specific fuel consumption.

Therefore, a precise control of the throat size of a stator vane set is important in the efficient operation of the turbine. Important dimensions for turbine nozzles are shown in FIG. 1 and include the thickness of the trailing edge A of the stator vanes and the distance from side walls B of adjacent vanes.

Another method of improving the efficiency of the engine is to coat the turbine airfoils with a thermal barrier coating (or, TBC) in order to allow for exposure to higher gas flow temperatures or reduced cooling air allotment and associated losses. In one prior art stator vane set, the nozzles are coated with a TBC around the entire circumference of the airfoil as seen in FIG. 2. Adding a TBC of thickness T to the airfoils will reduce the airfoil throat at the exit end by 2T and increases the trailing edge diameter of the vane by 2T. Recent advances in coating technology have resulted in a TBC thickness increased to levels as great as approximately 1.0 mm thick. This high thickness of the TBC has a significant impact on the critical aerodynamic dimensions of the nozzles as represented in FIG. 1.

FIG. 3 shows a prior art airfoil with a constant taper of the airfoil trailing edge contour C and a TBC applied in which the TBC tapers off from normal thickness to a zero thickness in which the metallic material of the airfoil at the trailing edge is exposed. This produces an airfoil with a surface contour that will be aerodynamically undesirable.

The prior art aerodynamic design accounts for the effect of TBC thickness when setting the airfoil throat dimension B, but tends to accept the increased thickness in dimension A. limitations of the prior art design practice are spallation of TBC results in a significant variation of the throat area over the life of the part, and increased aerodynamic losses associated with high trailing edge thickness.

BRIEF SUMMARY OF THE INVENTION

It is an object of the present invention to provide for a turbine airfoil with an improved sensitivity to spallation.

Another object of the present invention is to provide for a turbine airfoil with an improved aerodynamic performance.

Another object of the present invention is to provide for a turbine nozzle having a TBC with low aerodynamic losses due to spallation.

The present invention is a turbine nozzle in which the stator vanes include trailing edges with a TBC that blends into the airfoil surface to form a smooth aerodynamic surface to maintain an ideal surface contour. In one embodiment, the airfoil shape is altered to account for a tapered trailing edge TBC. In another embodiment, the underlying airfoil contour is thinned to accommodate a strip masking procedure in which the TBC is applied and then removed from the junction of the trailing edge to produce a smooth contour from the TBC to the metallic trailing edge of the airfoil. in another embodiment, the underlying airfoil contains locally raised bumps or tear drops which enable the coating to be stoned or lapped onto the airfoil surface to produce the ideal contour of the finished TBC.

DETAILED DESCRIPTION OF THE INVENTION

Figure 1:
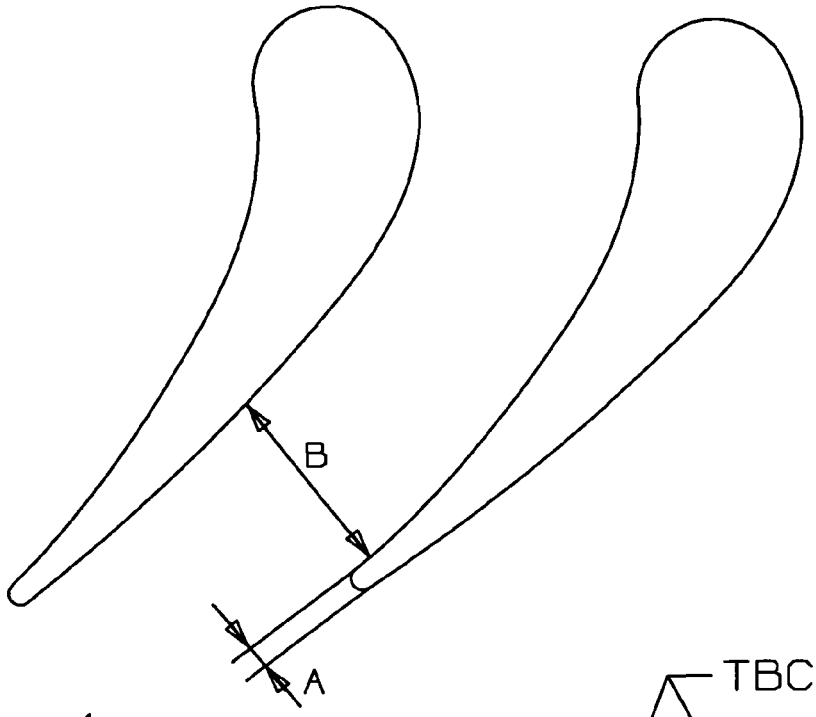
Fig 1 Prior Art
FIG. 1 shows a prior art uncoated turbine nozzle with dimensions of important aerodynamic factors.
Figure 2:
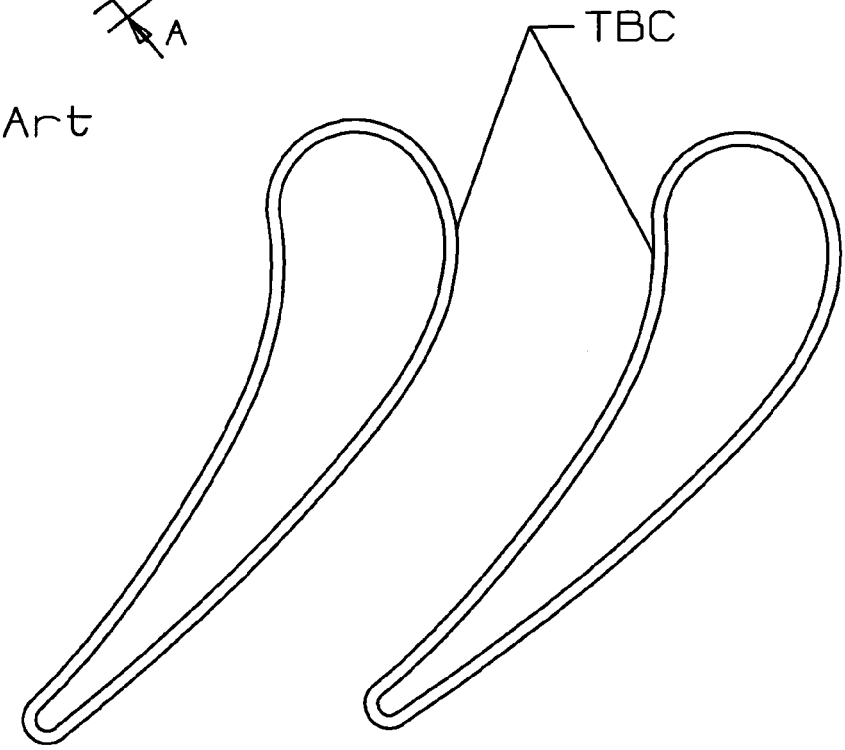
Fig 2 Prior Art
FIG. 2 shows a prior art turbine nozzle with a TBC applied around the entire airfoil surface.
Figure 3A:
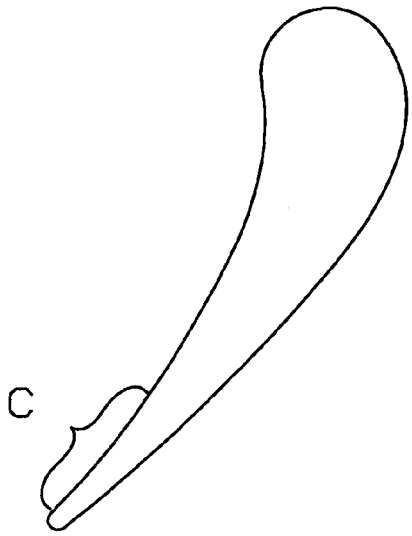
Fig 3a Prior Art
FIG. 3 shows a prior art turbine airfoil with a TBC tapering off at the trailing edge region.
Figure 4A:
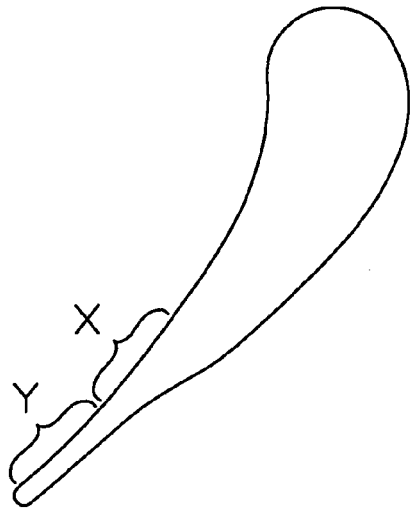
FIG. 4 shows a first embodiment of the airfoil with the TBC of the present invention.
Figure 3B:
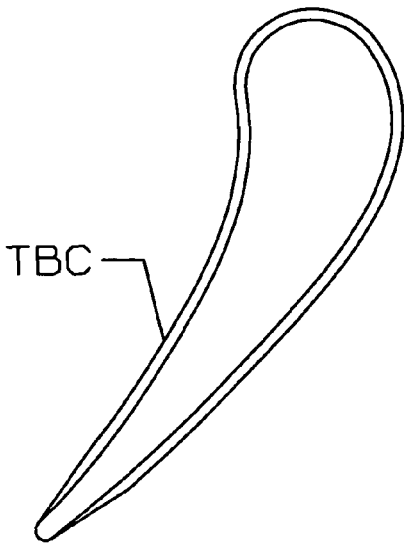
Fig 3b Prior Art
Figure 4B:
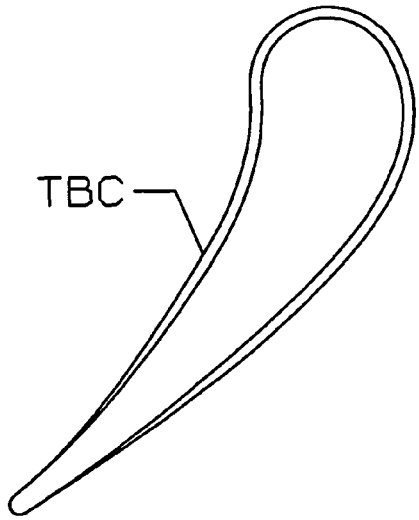

The present invention is a turbine nozzle guide vane in which the airfoil is coated with a TBC for protection against high temperatures and in which the nozzle throat area is controlled so that spallation does not significantly decrease the aerodynamic performance of the nozzles. FIG. 4 shows a first embodiment of the present invention. The top airfoil is an uncoated airfoil in which the underlying airfoil shape is altered to account for the tapered trailing edge TBC that will maintain an ideal surface contour. In the prior art airfoil of FIG. 3, a constant taper C of the airfoil trailing edge contour is formed so that the relatively thin TBC can be applied with the end tapering to zero thickness. In the airfoil of the present invention of FIG. 4, the airfoil contour includes a trailing edge section with a forward portion of greater taper X followed by an aft portion of no taper Y but relatively constant thickness from side to side. Thus, the taper of X is greater than the taper of Y along the trailing edge so that the relatively thicker TBC can be applied with the TBC tapering off to zero and still maintain the desired airfoil contour. The tapered sections X and Y in the FIG. 4 embodiment form a discontinuous taper angle at the airfoil trailing edge region.

Tapering the TBC at the trailing edge is possible through process control (coating spray guns are typically computer controlled robotics). If the coating is tapered on an airfoil shape of the prior art, the resulting surface contour will be aerodynamically unacceptable as shown in FIG. 3. The novel aspect of the present invention is that the underlying airfoil shape is altered to account for the tapered trailing edge TBC which therefore maintains an ideal surface contour as shown in FIG. 4.

Figure 5A:
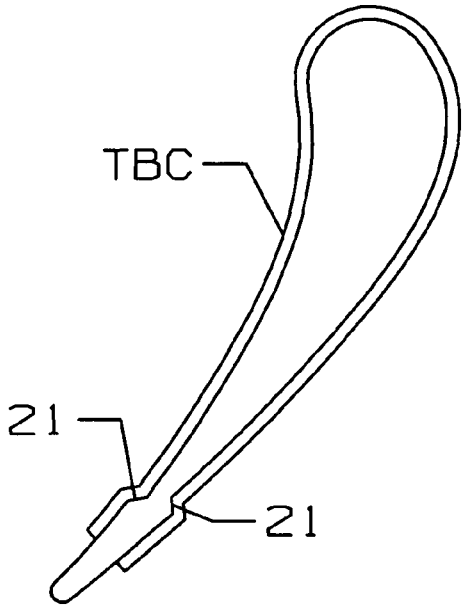
FIG. 5 shows a second embodiment of the airfoil with the TBC of the present invention.
Figure 5B:
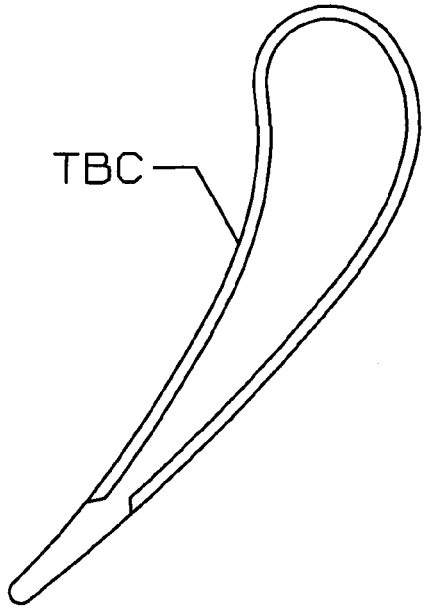

A second embodiment of the present invention is shown in FIG. 5. The final airfoil outer contour is shown in FIG. 5*b* in which the coating extends around the airfoil with a thickness and tapers off at the trailing edge region to a thickness of zero. The metal airfoil outer contour is reduced so that the coating will provide the final desired outer airfoil contour. In the FIG. 5 embodiment, a local increase in the airfoil trailing edge thickness is formed to accommodate strip masking. The tapered outer surface (21 on the pressure side and 22 on the suction side) at the trailing edge region allows for the TBC to smoothly progress from normal thickness to a zero thickness while the outer airfoil contour (metal surface and TBC) remains smooth. The relatively thick TBC will then blend into the outer airfoil surface and maintain the ideal surface contour critical to aerodynamic performance. Control of the trailing edge geometry is critical to aerodynamic performance, particularly on the pressure side.

To improve control of the trailing edge contour, the underlining airfoil contour can be designed to accommodate a strip masking process in which the coating is applied according to prior art application processes as shown in FIG. 5*a*, and then stoning or lapping is used to remove the masking as shown in FIG. 5*b*, therein leaving an ideal surface contour. The airfoil surface includes a taper 21 and 22 at the trailing edge region on both side walls as seen in FIG. 5*a*. The taper has a forward end of height equal to the desired thickness of the TBC to be applied, and includes a rearward end that tapers off to join the outer airfoil surface. The taper 21 on the pressure side wall is further aft than the taper 22 on the suction side wall surface. The airfoil surface contour is reduced in thickness from the pressure side taper to the suction side taper so that, when the TBC having the desired thickness is applied, the resulting airfoil surface contour with the TBC will form the ideal surface contour of the final airfoil surface (that outer surface that includes the metallic underlining and the TBC). When the TBC is applied to the airfoil surface over the tapered section, a TBC over-coating is formed as seen in FIG. 5*a* that extends aft from the taper. This over-coating is the material that is removed to produce the ideal surface contour.

Figure 6A:
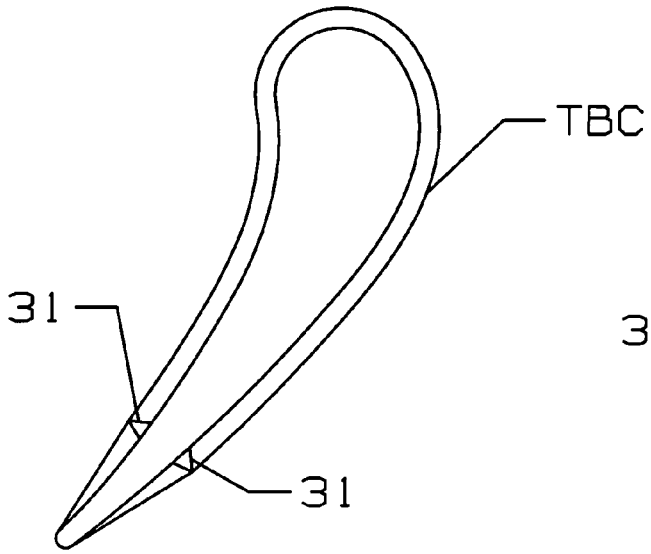
FIG. 6 shows a third embodiment of the airfoil with the TBC of the present invention.
Figure 6B:
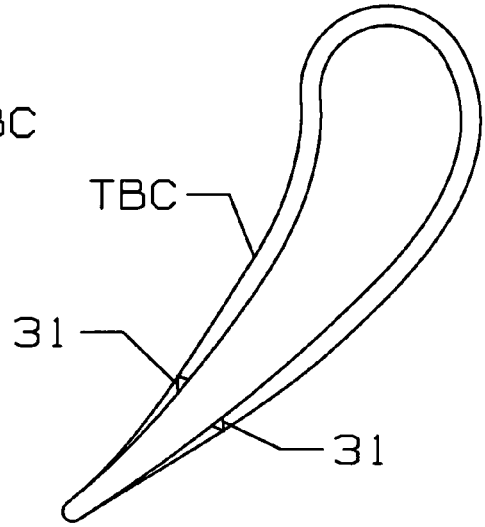
Figure 6C:
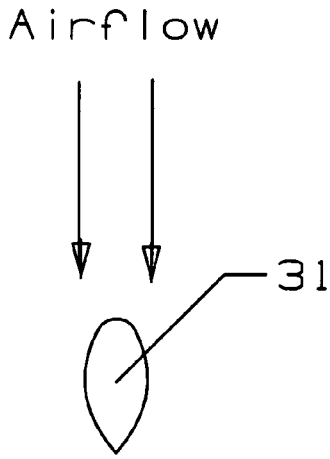

A third embodiment of the present invention is shown in FIG. 6. Control of the trailing edge geometry is critical to aerodynamic performance. To improve control of the coated trailing edge contour, the underlining airfoil is formed with locally raised bumps or tear drops 31 which will enable the coating to be stoned or lapped to the ideal contour. A number of these raised bumps 31 are located along the airfoil trailing edge and each has a height equal to the desired thickness of the coating. The bumps 31 are preferably cast into the airfoil surface when the airfoil is cast. The coating is then applied over the bumps 31 to cover the bumps 31 such that the bumps 31 are no longer visible. When the coating has hardened, the outer surface of the coating is removed by the stoning or lapping process down to the level of the bumps 31 so that the remaining coating has the desired thickness. The raised bumps 31 can be used a visual indicator of when the coating is at the desired thickness, or can be used to prevent further removal of the coating from the stoning or lapping process. In FIG. 6*a*, the TBC taper is difficult to control over a short transition distance. In FIG. 6*b*, the local bumps 31, combined with the stoning or lapping, is used to control the surface contour at the trailing edge. The bumps 31 can be teardrop shaped in the direction of the airflow (as seen in FIG. 6*c*) and widely spaced to minimize aerodynamic impact in the event of spallation.

The airfoil with the coating of the present invention can be an airfoil of either a rotor blade or a stator vane, both of which are used in a gas turbine engine.

I claim the following:

1. A turbine airfoil for use in a gas turbine engine, the turbine airfoil comprising:

a leading edge and a trailing edge;

a pressure side wall and a suction side wall;

the trailing edge region of the airfoil having a discontinuous taper angle such that when a TBC is applied to the airfoil an ideal surface contour is formed;

the discontinuous taper angle includes a first tapered section and a second tapered section located aft of the first tapered section, the second tapered section having less taper than the first tapered section; and, the second tapered section produces a substantially constant airfoil wall thickness.

2. The turbine airfoil of claim 1, and further comprising:

the TBC is a relatively thick TBC such that tapering off of the TBC at the trailing edge would produce an unacceptable aerodynamic surface contour on a prior art airfoil contour.

3. A turbine airfoil for use in a gas turbine engine, the turbine airfoil comprising:

a leading edge and a trailing edge;

a pressure side wall and a suction side wall;

the trailing edge region of the airfoil having a discontinuous taper angle such that when a TBC is applied to the airfoil an ideal surface contour is formed; and, a TBC applied over the airfoil surface, the TBC on the pressure side wall tapering off at the trailing edge to zero thickness.

4. The turbine airfoil of claim 3, and further comprising:

the TBC extends toward the trailing edge on the pressure side and the suction side walls of the airfoil, and the TBC tapers off to zero thickness substantially at the trailing edge of the airfoil on both sides.

5. A turbine airfoil for use in a gas turbine engine, the turbine airfoil comprising:

a leading edge and a trailing edge;

a pressure side wall and a suction side wall;

the trailing edge region of the airfoil having a discontinuous taper angle such that when a TBC is applied to the airfoil an ideal surface contour is formed; and, a plurality of local bumps extending out from the airfoil surface, each bump having a height substantially equal to the desired thickness of the TBC to be applied around the particular bump.

6. A turbine airfoil for use in a gas turbine engine, the turbine airfoil comprising:

a leading edge and a trailing edge;

a pressure side wall and a suction side wall;

a local increase in the airfoil thickness on the pressure side to accommodate strip masking; and, a TBC applied over the airfoil surface and ending at the local increase thickness.

7. The turbine airfoil of claim 6, and further comprising:

the local increase is formed on both the pressure side and the suction side walls.

8. The turbine airfoil of claim 7, and further comprising:

the airfoil outer surface is decreased in thickness from the pressure side local increase, around the leading edge of the airfoil, and ending at the local increase on the suction side such that a relatively thick TBC applied over the decreased airfoil thickness sections will produce an ideal surface contour.

9. The turbine airfoil of claim 8, and further comprising:

a TBC over the airfoil surface and extending from the local thickness increase from the pressure side around the leading edge and to the local thickness increase on the suction side such that a smooth transition from the TBC to the trailing edge airfoil surface is formed.

10. The turbine airfoil of claim 6, and further comprising:

the local increase is a tapered section.

11. The turbine airfoil of claim 6, and further comprising:

the local increase is located in the airfoil trailing edge region.

12. A process of forming a turbine airfoil with a TBC applied over the airfoil surface, comprising the steps of:

forming the airfoil surface with a contour having a local increase in airfoil thickness on the trailing edge region of the pressure side of the airfoil;

forming the airfoil surface with a reduced contour from the pressure side local increase in thickness to at least the leading edge of the airfoil;

applying a TBC to the airfoil surface and past the local increase in thickness such that an over-coating of the TBC is formed; and, removing the over-coated TBC such that a smooth surface contour is produced along the pressure side surface of the airfoil.

13. The process of forming the turbine airfoil of claim 12, and further providing the steps of:

forming a local increase in thickness on the suction side of the airfoil;

applying the TBC to the airfoil surface and past the local increase in thickness on the suction side such that an over-coating of the TBC is formed; and, removing the over-coated TBC on the suction side such that a smooth surface contour is produced along the suction side surface of the airfoil.

14. The process of forming the turbine airfoil of claim 13, and further providing the step of:

forming the airfoil surface with a reduced contour from the pressure side local increase in thickness, around the leading edge and to the local increase in thickness on the suction side.

15. The process of forming the turbine airfoil of claim 12, and further providing the steps of:

forming raised bumps on the airfoil surface; and, removing the TBC until the raised bumps are exposed.

16. A turbine airfoil for use in a gas turbine engine, the turbine airfoil comprising:

a leading edge and a trailing edge;

a pressure side wall and a suction side wall;

a positive taper on the pressure side wall and the suction side wall at a beginning of a trailing edge region of the airfoil;

a TBC applied over the airfoil and ending at the two positive tapers; and, the trailing edge region on the pressure side wall and the suction side wall is uncovered by a TBC.

17. The turbine airfoil of claim 16, and further comprising:

the positive taper on the pressure side wall is aft of the positive taper on the suction side wall.

18. The turbine airfoil of claim 16, and further comprising:

the TBC ending at the positive tapers is flush with the uncovered pressure and suction side walls of the trailing edge region.

19. The turbine airfoil of claim 18, and further comprising:

the discontinuous surfaces are formed by a positive taper.

20. A turbine airfoil for use in a gas turbine engine, the turbine airfoil comprising:

a leading edge region and a trailing edge region;

a pressure side wall and a suction side wall extending between the leading edge region and the trailing edge region;

a discontinuous surface formed between the pressure side and suction side walls and the trailing edge region;

the trailing edge region is not covered with a TBC; and, the pressure side and suction side walls are covered with a TBC with a smooth surface transition between the TBC covered walls and the uncovered walls of the airfoil.

* * * * *